United States Patent [19]

Despalmes

[11] 3,949,884

[45] Apr. 13, 1976

[54] TRANSPORTING AND LIFTING VEHICLE FOR HEAVY LOADS

[75] Inventor: Friedrich Despalmes, Vienna, Austria

[73] Assignee: Vereinigte Osterreichische Eisen- und Stahlwerke-Alpine Montan Aktiengesellschaft, Linz, Austria

[22] Filed: Oct. 24, 1974

[21] Appl. No.: 517,412

[30] Foreign Application Priority Data

Nov. 14, 1973 Austria ..... 9569/73

[52] U.S. Cl. ..... 214/1 D; 105/177

[51] Int. Cl.[2] ..... B25J 5/02

[58] Field of Search ..... 214/1 R, 1 D; 266/35, 36 P, 266/36 H; 254/105, 108, 109; 105/177, 238

[56] References Cited

UNITED STATES PATENTS

| | | | |
|---|---|---|---|
| 3,273,859 | 9/1966 | Walli | 254/109 |
| 3,312,544 | 4/1967 | McCready et al. | 105/177 X |
| 3,459,312 | 8/1969 | Britcher, Jr. et al. | 214/1 D |
| 3,510,012 | 5/1970 | Van Meteren | 254/105 X |
| 3,653,879 | 4/1972 | Wienert | 266/36 P X |
| 3,715,101 | 2/1973 | Pultringer | 214/1 D X |

*Primary Examiner*—Frank E. Werner
*Attorney, Agent, or Firm*—Brumbaugh, Graves, Donohue & Raymond

[57] ABSTRACT

There is disclosed a transporting and lifting vehicle for heavy loads, in particular for converter exchange vessels used in steel production. The vehicle comprises a travelling frame and a lifting frame that carries a lifting means and receives. The converter, the travelling frame is preferably rotatable about a vertical axis for the purpose of transposing the vehicle at track intersections. The travelling frame is provided with turret-like projections having recesses and the lifting means is preferably in the form of bilaterally acting hydraulic pistons connected with traverse-like carriers arranged below the lifting frame. At the end of the carriers extractable and retractable bolts are provided. The lifting frame is also provided with extractable and retractable bolts, whereby after actuating the lifting means at a lower lifting height, than the total lifting height the bolts of the lifting frame and the bolts of the traverse-like carriers are alternately engageable and disengageable in turns with the recesses.

15 Claims, 19 Drawing Figures

II
II
IV
IV
1
2
3
4
5
5a
6
7
8
9
10
11
12
13
15
16
17
18
21
22
23
24
27
28
29

23
24
5a
4
13
10
12
18
21
5
22
14
15
3
2
19
27
20
6
7
9
11
8

FIG. 4
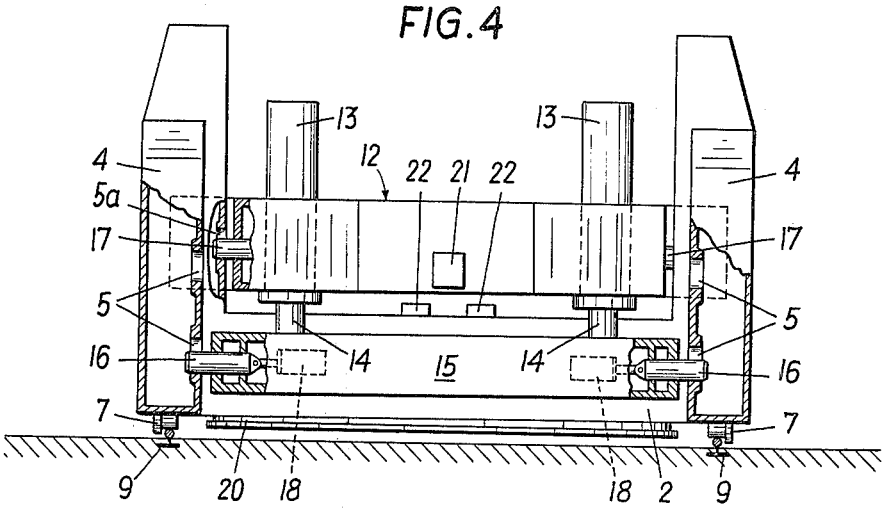
FIG. 5
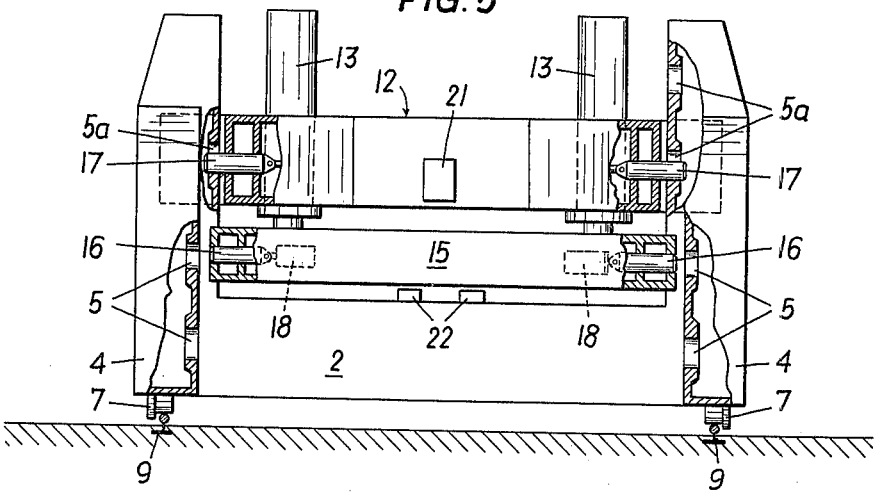
FIG. 6
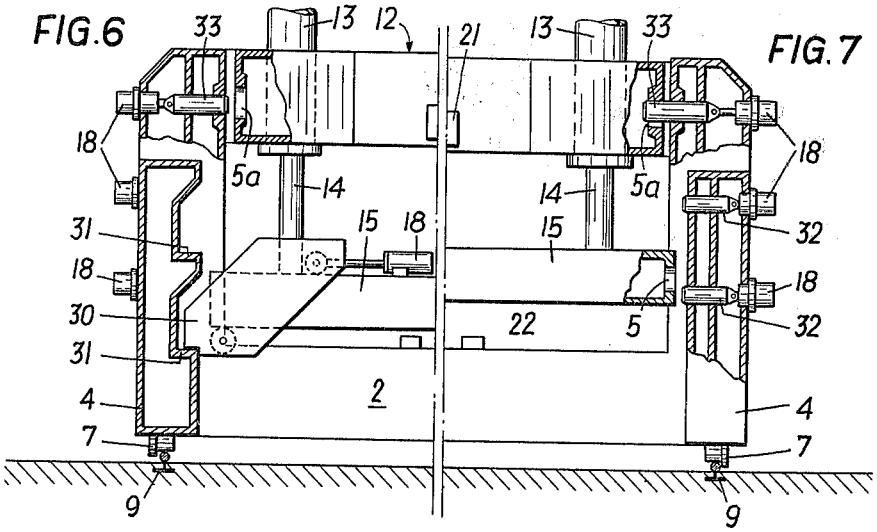
FIG. 7

TRANSPORTING AND LIFTING VEHICLE FOR HEAVY LOADS

BACKGROUND OF THE INVENTION

The invention relates to a transporting and lifting vehicle for heavy loads, in particular for converter exchange vessels used in steel production. The vehicle has a travelling frame and a lifting frame that carries a lifting means and receives the converter. The travelling frame is preferably rotatable about a vertical axis for the purpose of transposition at track intersections.

Transporting and lifting vehicles that travel on rails are used for lowering converter exchange vessels, which have to be relined from time to time, from the converter stand, transporting them to a distant lining and repair stand and lifting them into the repair stand. The removed converter is replaced by a spare vessel, which is lifted into the converter stand by means of the transporting and lifting vehicle so that the steel production may be continued. Since a direct rail connection between converter stand and lining stand is often not possible, a transporting and lifting vehicle must be capable of changing its travelling direction to rail intersections at any angle without additional devices, such as turntables or other auxiliary devices which do not form part of the vehicle. When mounting the converter it should also be possible to carry out adjusting movements of the vehicle with the converter vessel in lifted position so that it can be brought into a position corresponding to the bearing zones in the converter carrying ring.

Apart from the carrying capacity the effective lifting height of the lifting mechanism is an essential characteristic of a transporting and lifting vehicle. This lifting height may have to change depending on the construction of the converter plant. Thus, converter construction provided with a horseshoe-shaped carrying ring open at one side require small to medium lifting heights of approx. 0.5 to 1.5 m depending on whether the converter is secured to the upper or lower side of the carrying ring. However, converter constructions provided with a closed carrying ring in general need a comparatively large lifting height of approx. 3 to 4 m, since in this case the lifting height when removing the converter relates to the converter hood.

Moreover, on account of the location of surrounding constructions, such as e.g high platforms, crane runways, etc., it may be necessary to lower the converter below the height that is essential when removing the converter from the carrying ring. It is possible that it may have to be lowered as far as immediately above the mill floor and transported in this position in order to avoid a collision with the surrounding constructions.

Since closed converter carrying rings, as compared to carrying rings open at one side, have the advantage of greater stability and nondeformability it is advantageous to use them, particularly for large and heavy exchange converters, wherein faultless and economical handling of the task of the transporting and lifting vehicle, namely to moving heavy loads over wide lifting ranges, is a prerequisite.

It would be desirable to provide an operationally reliable transporting and lifting vehicle, by means of which the load may be lowered to the rail level and may in turn be lifted to any mounting position, even to a considerably high one.

The known transporting and lifting vehicles do not meet these demands or do not meet them completely. If they did fulfill the above demands their lifting means would become too heavy and uneconomical. Thus, transporting and lifting vehicles, e.g. as they are described in German Auslegeschrift No. 2,023,965, in which vehicles load carrying parts act below the vessel bottom, are not suited for solving this task, since there would be no room for them when the converter is in lowered position.

Yet constructions in which column-like lifting elements are provided for lifting the load, in particular hydraulic piston mechanisms, and whose lifting path is equal to the load path (see e.g. German Auslegeschrift No. 1,433,664) are not well suited for the purpose either, because the required cylinder and piston dimensions with high lifting heights would be disproportionately large on account of the long guiding and buckling lengths, hence, would be uneconomical.

In another known transporting vehicle, as it is described in the German Auslegeschrift No. 1,916,843 the lifting height of the hydraulic piston mechanisms is reduced in that a carrying frame receiving the converter is rotatably supported in a ring, which in turn is suspended on chains or ropes guided over guide pulleys and secured to the vehicle frame. The guide pulleys themselves are carried by piston rods of the hydraulic piston mechanisms that have their cylinder housings firmly connected with the travelling frame. With this arrangement of the lifting mechanism a single force path, yet with double the lifting power of the lifting pistons, a load path which is twice as long as the piston stroke is covered. The disadvantages of this construction lie, however, in the fact that the lifting elements have to be built heavily on account of the load transmission to a faster movement, that additional machine elements which are subject to heavy wear, such as guide pulleys and drawing means, are necessary and that with large lifting heights for the load the lifting elements have to have a considerable length on account of the unalterable transmission of the "loose pulley".

SUMMARY OF THE INVENTION

The present invention aims at avoiding the above mentioned disadvantages and difficulties and it comprises a transporting and lifting vehicle of the above described type in which the travelling frame is provided with turret-like projections having recesses. The lifting means, which are preferably bilaterally acting hydraulic piston mechanisms, are connected with tranverse-like carriers arranged below the lifting frame. At the ends of the carriers retractable and extractable bolts are provided and the lifting frame is also provided with retractable and extendable bolts. After actuating the lifting means — with a lower lifting height than the total lifting height — the bolts of the lifting frame and the bolts of the traverse-like carriers are engageable and disengageable alternatingly one after the other with the recesses of the turret-like projections.

Preferably the traverse-like carriers have the form of closed frames.

The travelling frame may be rectangular-shaped and the turret-like projections may be arranged symmetrically in the corners of the frame.

According to a preferred embodiment of the invention bolts of the lifting frame or of the traverses that are opposite each other are adjustable so that the climbing lifting mechanism is horizontally shiftable in relation to the travelling frame and is thus capable of being centered. For this purpose preferably stops are provided in the recesses of the turret-like projections.

In a modified embodiment of the invention the retractable and extendable bolts are provided at the turret-like projections and the recesses are provided in the lifting frame and in the traverse-like carriers arranged below it.

The invention further includes a modified embodiment in which turning of the vehicle is carried out with less mechanical effort so that heavy local stresses on the foundations at track intersections are avoided and the foundations can therefore be built less massive, which means that costs can be saved.

For this purpose the frames of the transporting and lifting vehicle have inner dimensions which are larger than the diameter of the lower part of the converter so that the converter can be lowered through the open inner part of the frame and can be placed on the foundation.

According to an embodiment in which the converter is carried by the lifting frame, the rotating frame which is connected with the travelling frame by means of axial bearings and a rotation drive, is provided with auxiliary lifting means, preferably bilaterally acting hydraulic piston mechanisms that are capable of being actuated after the converter has been lowered onto the foundation. The lifting frame and the travelling frame are connected by followers so that when the rotation drive is actuated the lifting frame and the travelling frame are rotatable in relation to the rotating frame and to the converter.

At its circumference, preferably at its outer circumference the rotating frame is provided with a tooth wheel rim or a pin gear, into which a pinion engages. The drive and bearing housing of the pinion is rigidly connected with the travelling frame so that when the pinion is being driven it rolls against the stationary tooth wheel rim of the rotating ring that is supported by the foundation and transposes the travelling frame together with the lifting frame into a direction of travel via the drive and bearing housing.

According to another preferred embodiment, in which the converter is carried by the lifting frame, the rotating frame which is connected with the lifting frame by means of an axial bearing and a rotation drive, is, after the converter has been placed on the foundation, also capable of being placed on the foundation. On further retracting the lifting means and actuating the rotation drive, the lifting means and the travelling frame which are connected by followers, are rotatable in relation to the rotating frame and in relation to the converter.

Finally a further embodiment of the transporting and lifting vehicle of the invention, wherein the converter is carried by the rotating frame, has the rotating frame, which is connected with the lifting frame by means of axial bearings and a rotation drive, is, after the converter has been placed on the ground, also supportable on the ground. On further retracting the lifting means, the travelling frame and the lifting frame connected by followers are rotatable in relation to the rotating frame and in relation to the converter.

The main advantages of these embodiments lie in the fact that the actual load, which is a multiple of the vehicle weight, is placed on the foundation prior to the transposing procedure at track intersections so that this actual load is eliminated during the procedure, also, the construction units necessary for the transposing procedure, such as the means for lifting the vehicle off the track, the rotation bearing arrangement and the rotation ring, as well as the rotation drives, need be dimensioned only for carrying and rotating the unloaded vehicle. Thus, in the construction of the vehicle weight and costs can be saved. On account of the possibility of relatively large support zones for the load and the relatively low weight of the vehicle, concentrated heavy stress on the foundations at track intersections is avoided. The foundations need, therefore, not be built as robust as has been necessary so far.

BRIEF DESCRIPTION OF THE DRAWINGS

The invention and the embodiments thereof will now be illustrated in more detail by way of example with reference to the accompanying drawings, in which:

FIGS. 4 to 7 illustrate cross sections along line IV—IV of FIG. 1 of the vehicle in various lifting phases;

DESCRIPTION OF EXEMPLARY EMBODIMENTS

Figure 1:
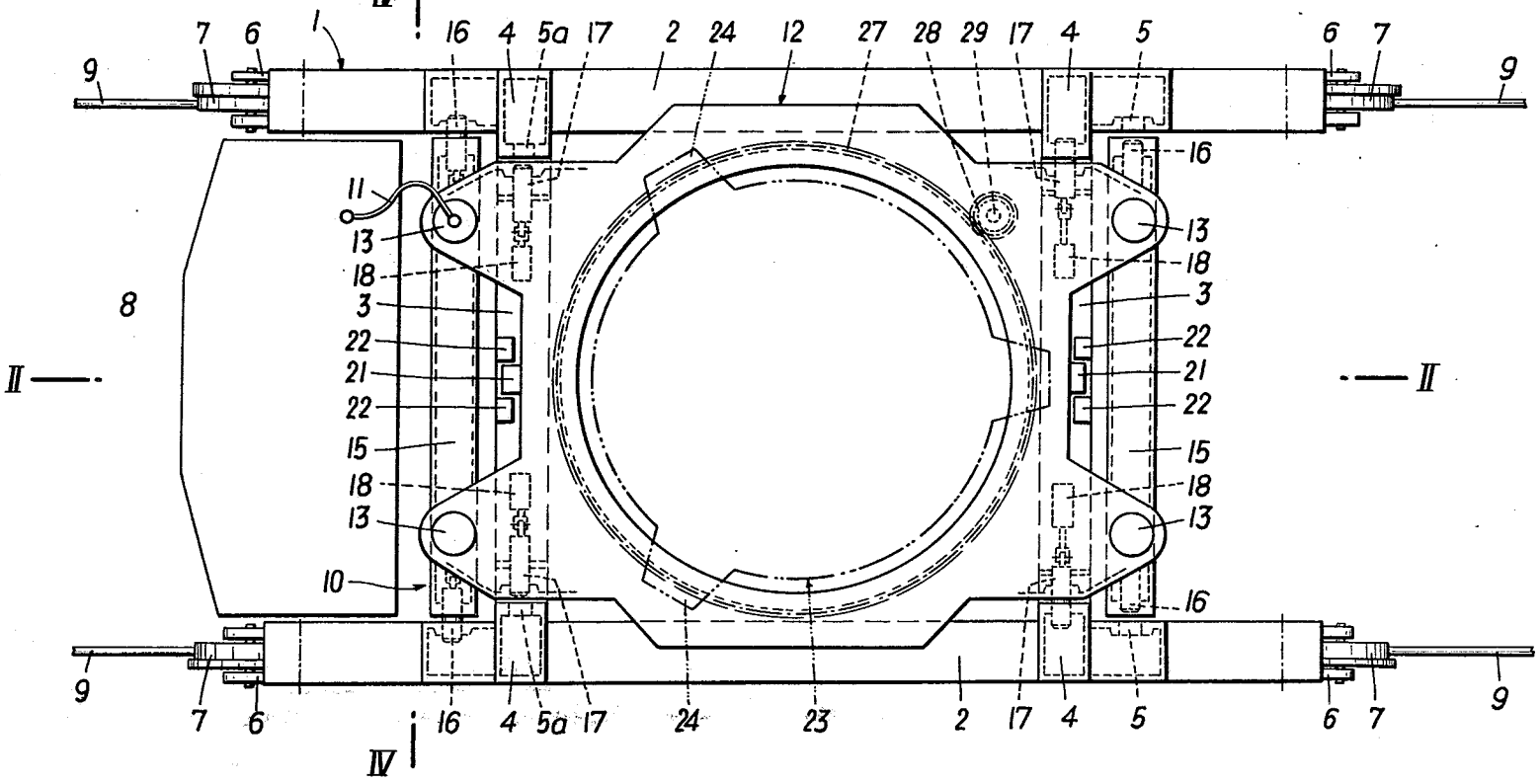
FIG. 1 is a top view of the transporting vehicle.

The transporting and lifting vehicle as it is shown in FIGS. 1 to 10 comprises a travelling frame 1 formed by the longitudinal beams 2 and the cross beams 3. In the corners or intersection points of the travelling frame turret-like projections 4 having slit-like recesses 5 and 5*a* are provided. Four running wheel rockers 6, in which running wheels 7 are borne are hinged on the travelling frame 1. A driver's stand 8 is mounted on the travelling frame. The vehicle runs on rails 9. In the opening enclosed by the projections 4 the climbing-lifting mechanism 10 is inserted. It is connected with the driver's stand via flexible supply conduits or control lines 11. The climbing-lifting mechanism has a lifting frame 12, in which four lifting means in the form of load lifting cylinders 13 are fastened. Their retractable and extractable pistons 14 are connected at their ends in pairs by means of traverses 15. Both in the traverses 15 and in the lifting frame 12 retractable and extractable bolts 16, and 17 are borne. These bolts may be shifted by adjusting means 18, which preferably have the form of bilaterally acting hydraulic pistons.

Figures 2, 3:
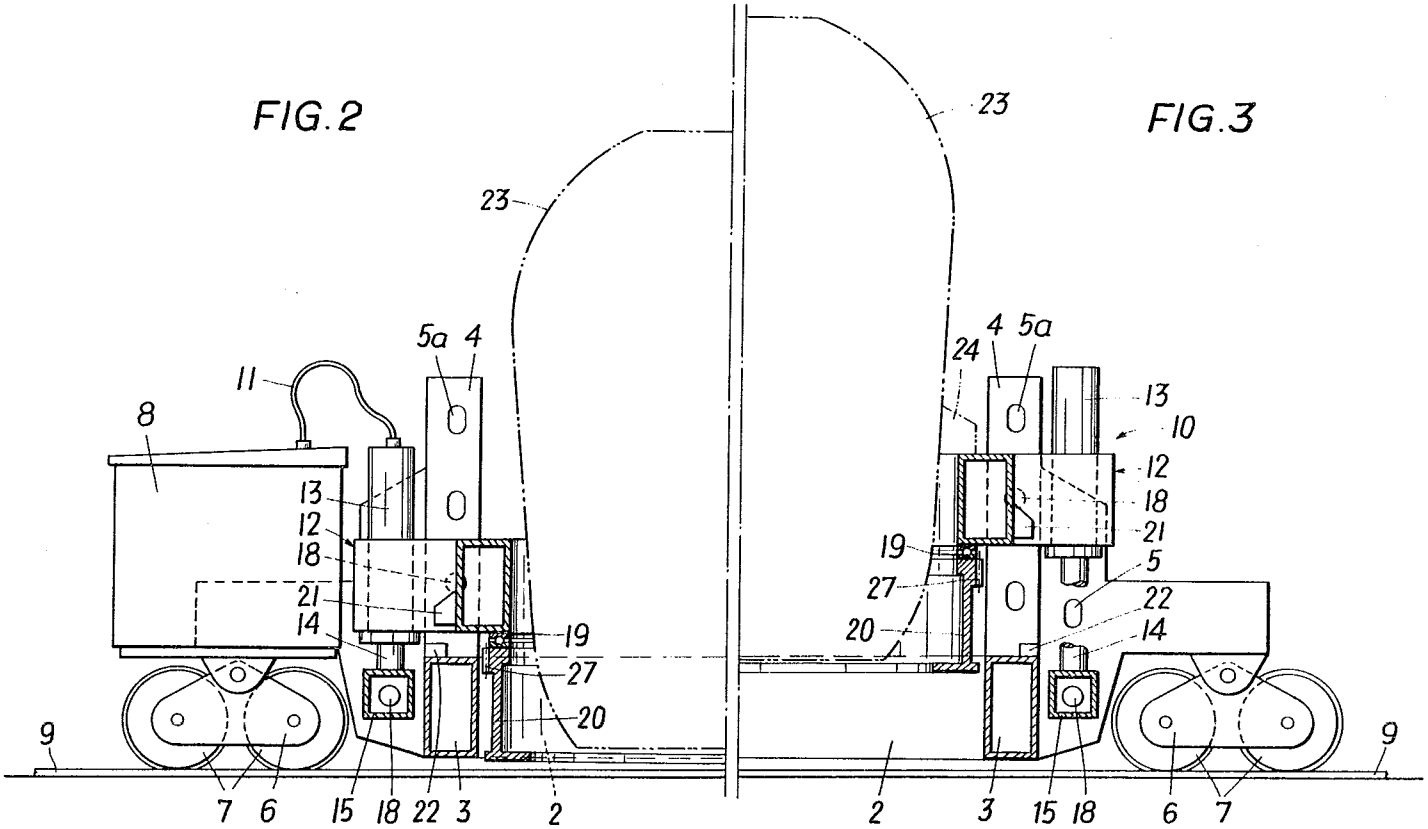
FIGS. 2 and 3 represent longitudinal sections along line II—II of FIG. 1.

The lifting frame 12 is connected via a bilaterally acting axial bearing 19 with a rotating frame 20, that possesses a tooth wheel rim 27. A pinion 28 capable of being driven has a drive and bearing housing 29 that is secured to the lifting frame and engages with the tooth wheel rim. On the lifting frame 12 two followers 21, lying diametrically opposite each other, are provided and on the travelling frame four follower blocks 22 are provided. The followers 21 are engaged between the follower blocks 22. FIGS. 2 and 4 illustrate the transport position of the vehicle. The converter 23 rests with its claws 24 on the lifting frame 12, which in turn is supported by the travelling frame 1 via the extracted bolts 17. The bolts 17 engage in the of the receiving slits 5*a* of the turret-like projections 4. According to the position illustrated in FIG. 2 and FIG. 4, respectively, the lifted position of the lifting frame is such that the lower edge of the rotating frame 20 lies just above the rails 9. The lifting pistons 14 are almost entirely retracted so that the traverses 15 connecting the lifting pistons 14 lie close to the lifting frame 12. The cylinder chambers of the lifting cylinders 13 are pressureless. The bolts 16 of the traverses 15 are engaged in the recesses 5 and transmit the weight of the traverses and of the lifting pistons via the receiving slits 5*a* onto the travelling frame 1, which is supported by the rails 9 via the running wheel rockers 6 and the running wheels.

From this position the first climbing step is effected in that the lifting pistons 14 are driven out wherein the lifting frame 12 together with the load is moved upward and the bolts 17 of the lifting frame are lifted off their support zones. At the same time the bolts 16 of the traverses 15 transmit the entire load of the climbing lifting mechanism 10 together with the converter 23 in the above described manner onto the travelling frame. During the upward movement of the lifting frame the bolts 17 are retracted so that when they pass the upper slit end they do not impede the lifting procedure. It is also possible after releasing the bolts 17 to interrupt the lifting movement of the pistons 14 until the bolts 17 are retracted and then to continue the lifting procedure. After the lifting pistons have been driven out the lifting movement is interrupted, whereby the position according to FIG. 3 is achieved. The bolts 17 of the lifted lifting frame 12 are now in the range of the next highest of the slits 5*a* and may be inserted into these slits. After this has been done the lifting pistons 14 are retracted, wherein the lifting frame 12 moves downward until the bolts 17 rest in the bottom of the corresponding recesses 5*a*. When retracting the lifting pistons 14 further the traverses 15 are lifted, wherein their released bolts 16 are disengaged in the same way as described above with respect to bolts 17. After retracting the lifting pistons 14 entirely the traverses 15 lie immediately below the lifting frame 12, wherein the bolts 16 of the traverses then lie in the range of the next highest of the slits 5 (FIG. 5). The bolts 16 are driven into the slits and thus completing the first climbing phase. The further climbing steps up to the next highest recesses 5 and 5*a* occur analogously.

FIG. 6 illustrates a modified embodiment of the turret-like projections of the vehicle and of the bolt-shaped means engaged in these projections. These means are e.g. in the form of slide-shaped brackets 30 secured to the traverses 15 and act together with notches 31 on the projections 4 of the travelling frame. The brackets are moved by adjusting means 18 secured on the traverses.

Figure 8:
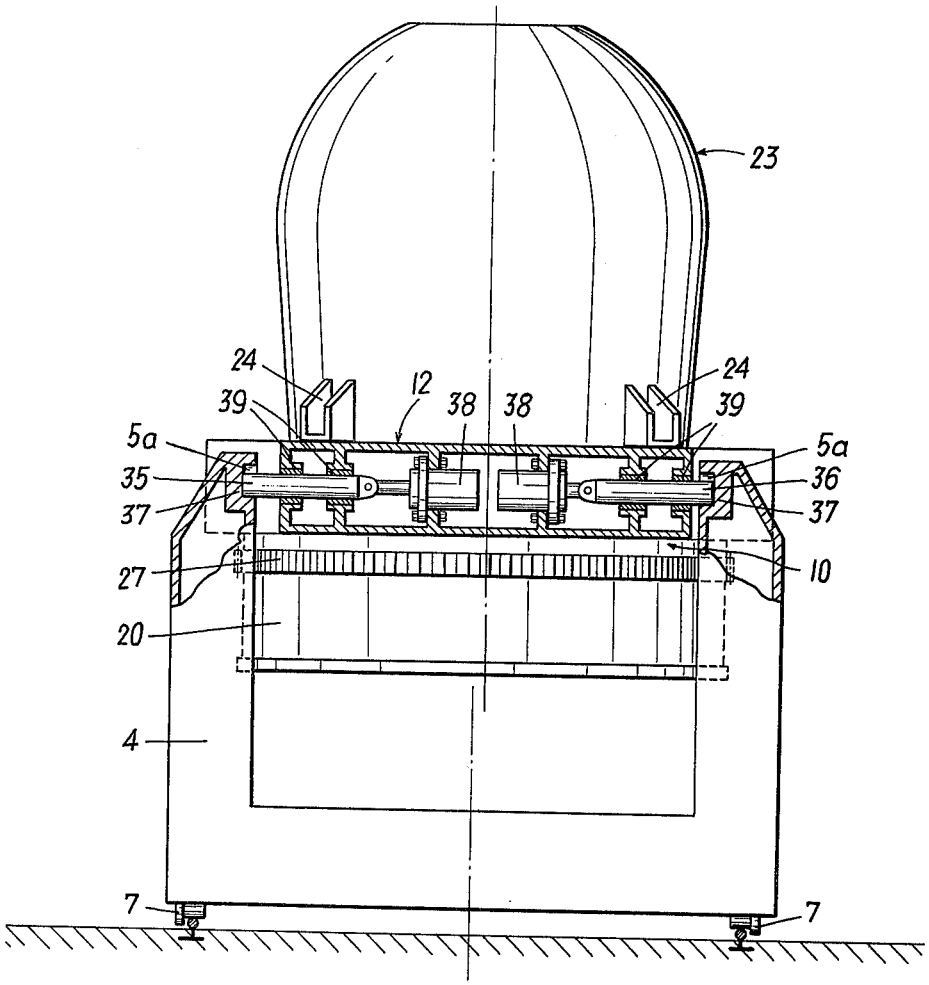
FIGS. 8 and 9 show embodiments in which the climbing lifting mechanism is capable of carrying out additional horizontal movements.
Figure 9:
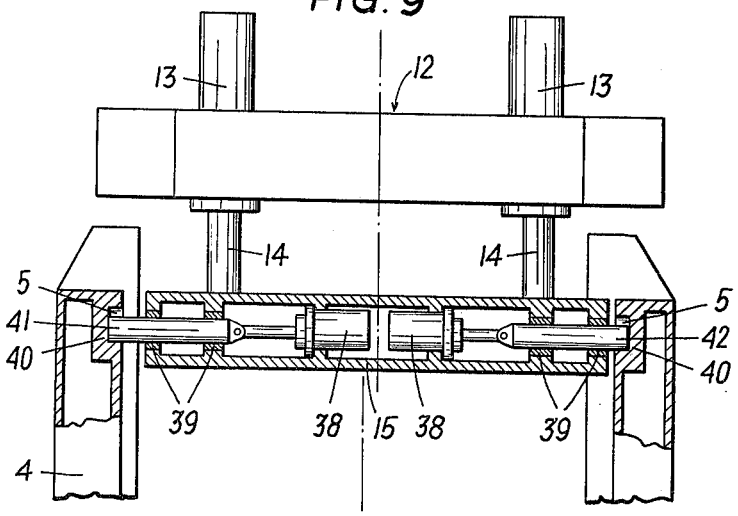

In the embodiment according to FIG. 7 bolt-shaped engagement means 32, and 33 are shown, which are shiftably borne in the turret-like projections 4 of the travelling frame and may be shifted by adjusting means 18 supported in the projections 4. In this embodiment the lifting frame 12, and the traverses 15 are provided with corresponding receiving slits 5*a* and 5, respectively. FIGS. 8 and 9 illustrate means for shifting the climbing lifting mechanism in the transverse direction. FIG. 8 shows the climbing lifting mechanism in lifted position during a transverse shifting towards the right, wherein the bolts 35 and 36 of the lifting frame 12 rest in the axial direction against stops 37 of the receiving slits 5*a*. The bolts 35 lying on the left-hand side are extended by adjusting means 38 and the bolts 36 lying on the right-hand side are retracted synchronously thereto by adjusting means 38 so that the lifting frame 12 slides towards the right on the bolts 35 and 36 via sliding bushings 39 arranged in the lifting frame. In this way a simple centering transverse to the rail direction is possible. FIG. 9 shows a transverse shifting of the climbing lifting mechanism 10 via the traverses 15, wherein the bolts 41 and 42 rest in the axial direction against stops 40 of the receiving slits 5. The bolts 41 lying on the left-hand side are extended by adjusting means 38 and the bolts 42 lying on the right-hand side are retracted synchronously thereto by adjusting means 38 so that the traverses 15 slide towards the right on the bolts 41 and 42 via sliding bushings 39 built into said traverses. Therefore, the lifting frame 12 is carried along in the shifting procedure via the piston rods 14 which are secured to the traverses 15, and via the cylinders 13.

Figure 10:
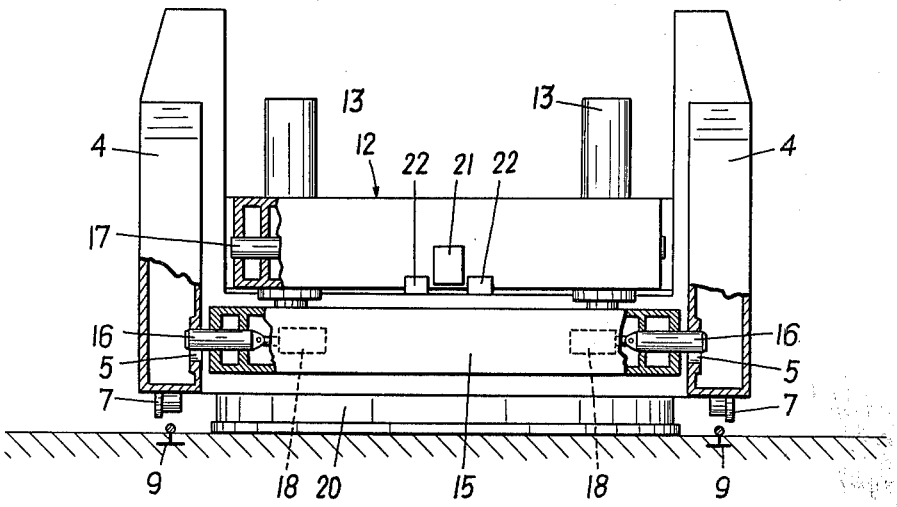
FIG. 10 illustrates a preparatory position prior to the transposition at track intersections.

FIG. 10 shows a preferred embodiment of the transporting and lifting vehicle in a preparatory position for the transposition at track intersections. In this position the lifting frame 12 is lowered so far that the rotating frame 20 rests on the foundation. When the lifting means are retracted still further the bolts 16 of the traverses 15 come to lie against the upper limiting surfaces of the lowest recesses 5 and lift the travelling frame off the rails.

Figure 11A:
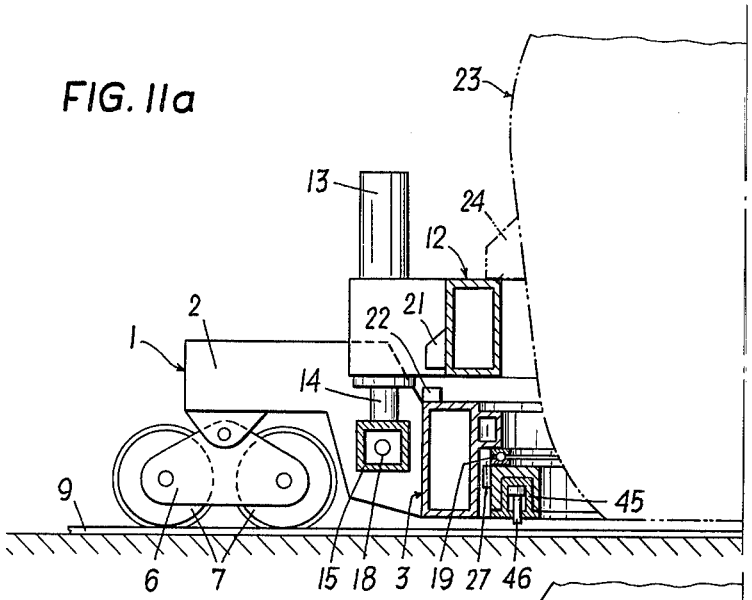
FIGS. 11 to 13 illustrate in more detail the construction and function of the transporting and lifting vehicle while placing the converter on the foundation, wherein the FIGS. 11*a*, 12*a*, 13*a* show the transport position.
FIGS. 11*b*, 12*b*, 13*b* illustrate the rotating position.
FIG. 11*c* represents a section *c*—*c* of FIG. 11*b*, and FIGS. 12*c* and 13*c* show top views of the vehicle.
Figure 11B:
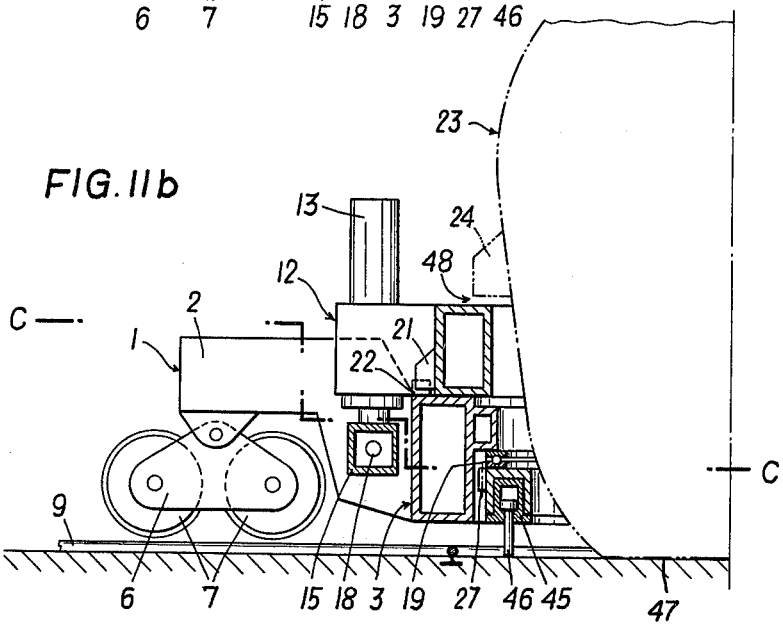
Figure 11C:
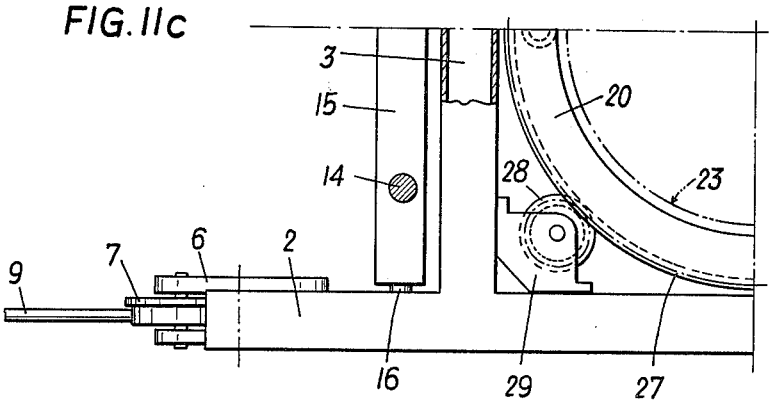

The vehicle shown in FIGS. 11*a*–11*c* is similar to the vehicle in FIGS. 1 and 2 and similar parts have been marked with the same reference numbers. As can be seen the inner dimensions of the lifting frame 12 of the transporting and lifting vehicle shown in FIGS. 11*a* to 11*c* are big enough so that the lower part of the converter 23 can pass through the inner part. Likewise the inner areas of the travelling frame 1 and of the rotating frame 20 are big enough so that the lower part of the converter may be lowered through these inner parts and may be placed upon the foundation 47. Upon further lowering of the lifting frame 12 into a final lower position, play develops between the support zones of the lifting frame 12 and the supporting claws 24 of the converter 23.

The rotating frame 20 is provided with at least three bilaterally acting auxiliary lifting cylinders 45 distributed over the circumference of said frame. The pistons 46 of cylinders 45 are, after having reached the above described final position of the lifting frame, extended so far downward that they rest on the foundation 47 and lift the travelling frame together with the lifting frame so far that, on the one hand, the running wheels 7 are lifted off the rails 9 and, on the other hand, a residual play 48 remains between the converter claws 24 and the support zones of the lifting frame 12.

FIG. 11*b* illustrates this position in which the travelling frame 1 can be rotated in relation to the stationary rotating frame 20 and to the converter 23 by driving the pinion 28, borne on the travelling frame, and the lifting frame 12, connected with the travelling frame, in a rotary direction via the blocks 22 and the followers 21.

From FIG. 11*c* the arrangement of the rotation drive with the drive and bearing housing 29 of the pinion 28 can be seen.

The essential advantage of this construction consists in that the rotating frame, the rotation bearing arrangement, the rotation drive and the auxiliary lifting means need not be constructed to withstand more than the relatively low weight of the vehicle without the converter. This means that considerable savings in weight and costs can be achieved.

Figure 12A:
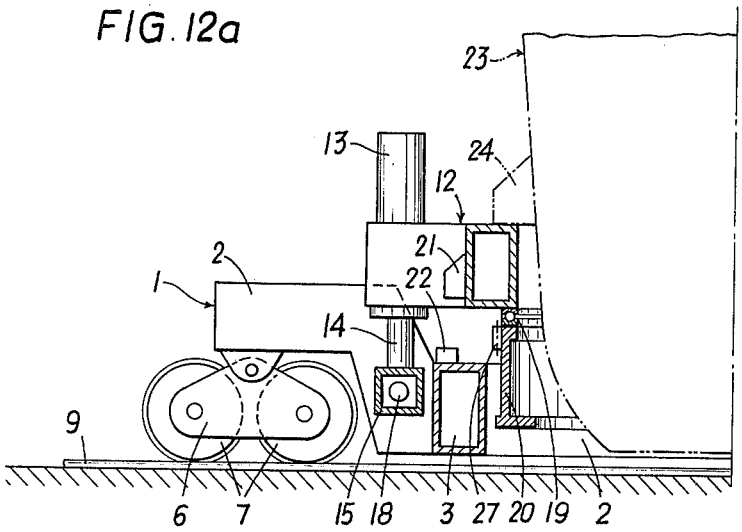
Figure 12B:
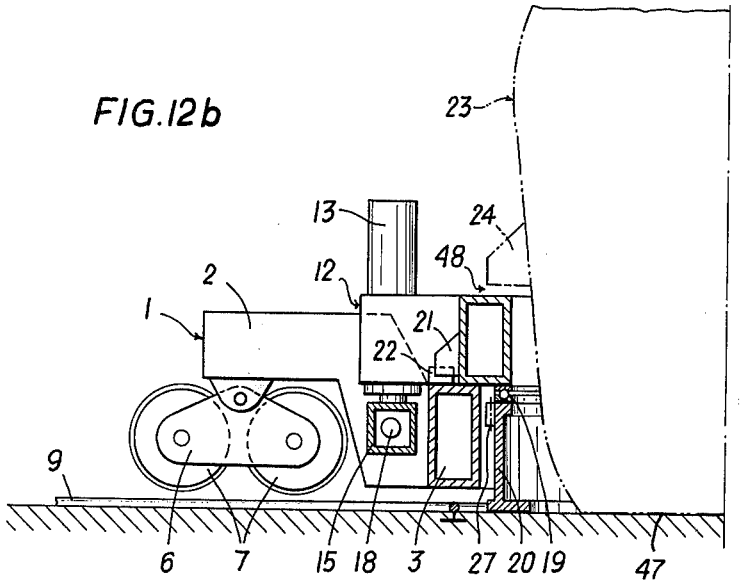
Figure 12C:
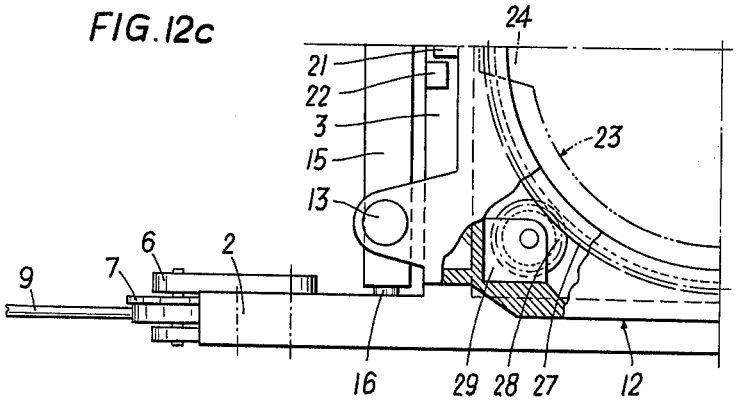

The embodiment according to FIGS. 12*a* to 12*c* differs from the embodiment shown in FIGS. 11*a* to 11*c* in that the rotating frame 20 is connected with the lifting frame 12 instead of with the travelling frame via the axial bearing 19 and in that the drive and bearing housing 29 of the pinion 28 is secured to the lifting frame. In this embodiment the auxiliary lifting means 45, 46 are missing.

The other parts of the transporting and lifting vehicle are the same as described in connection with FIGS. 11*a* to 11*c*.

The rotation or transposition procedure for the vehicle of FIGS. 12*a* to 12*c* is carried out as follows: by retracting the pistons 14 into the cylinders 13 in order to lower the lifting frame 12. As a result first the converter, which in the travelling position of the vehicle projects downward out of the rotating ring, is placed on the foundation 47 and then upon further lowering of the lifting frame 12 the rotating frame 20 comes to rest on the foundation 47. A play 48 is thereby created between the converter claws 24 and the support zones of the lifting frame 12. Upon further retraction of the lifting pistons 14 the travelling frame 1 is lifted by said pistons via the traverses 15 until the running wheels 7 are lifted sufficiently far off the rails 9. This position is illustrated in FIG. 12*b*, in which the lifting frame 12 and the travelling frame 1, which are connected in the rotating direction via the followers 21 and the blocks, are capable of being rotated in relation the stationary rotating frame 20 and to the converter 23 by driving the pinion 28 borne on the lifting frame.

From FIG. 12*c* the arrangement of the rotation drive can be seen.

Figure 13A:
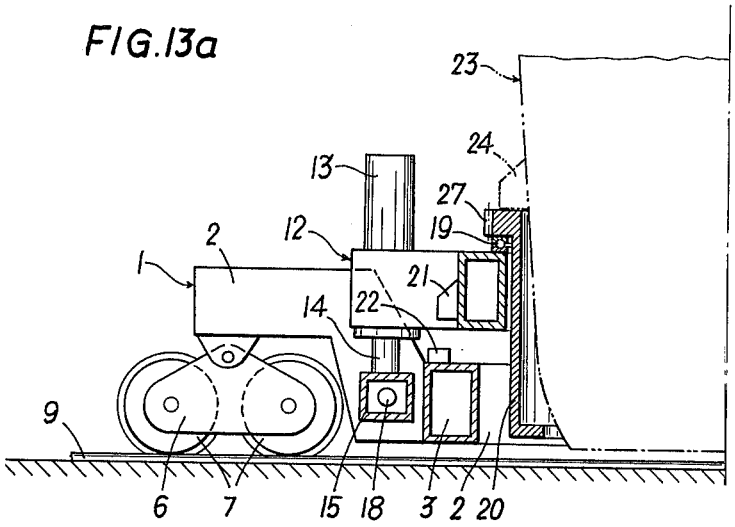
Figure 13B:
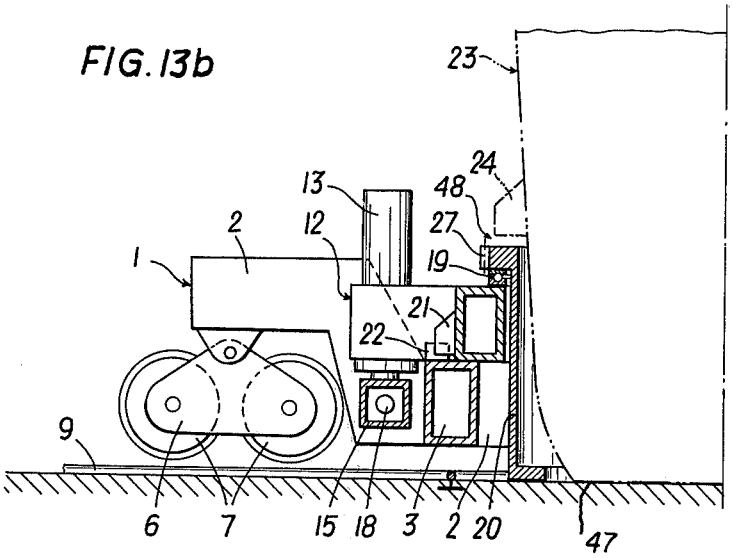
Figure 13C:
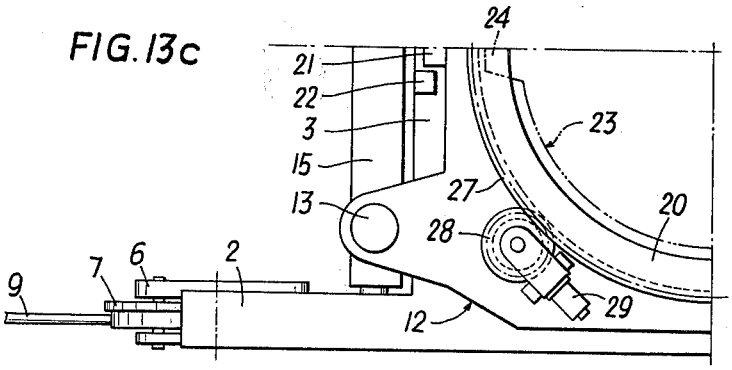

The embodiment shown in FIGS. 13*a* to 13*c* differs from the already described embodiment according to FIGS. 12*a* to 12*c* in that the converters 23 is carried by the rotating frame 20, which in turn is supported via the axial bearing 19 by the lifting frame 12. The driveand bearing housing 29, whose pinion 28 engages with the tooth wheel rim 27 of the rotating frame 20, is connected with the lifting frame, which in turn is connected with the travelling frame via followers 21 and blocks 22.

The transposition procedure for the vehicle of FIGS. 13*a* to 13*c* is effected by lowering the lifting frame 12 so that the converter 23 is first placed upon the foundation 47. Upon further lowering of the lifting frame 12 the rotating frame is also placed upon the foundation 47, thereby creating play 48 between the converter claws 24 and the support zones of the rotating frame 20.

Upon further retraction of the lifting pistons 14 the travelling frame 1 is lifted by the pistons via the traverses 15 until the running wheels 7 are lifted sufficiently high off the rails 9.

In this embodiment the axial bearing 19, when the vehicle is in the travelling position and in the lifting phases, is loaded by the weight of the converter and the rotating frame when the rotating frame is stationary and the bearings are consequently not being moved. The arrangement does, however, permit angular correction movements of the rotating frame and hence of the converter when the latter is being raised into its carrying ring, since the minor rotatory movements of the rotating frame can be carried out at low speed.

Since the dead load on the axial bearing 19 when the vehicle is in the travelling position and possibly the minor rotating movements under stress by the converter and the rotating frame when the vehicle is in a lifting position represent only a high "static load" on the axial bearing 19, the bearing may preferably be in the form of a roller bearing. This is ture since the "dynamic load" of the axial bearing during the rotation procedure at track intersections includes only the relatively low weight of the travelling frame and the lifting frame, because the converter and the rotating frame rest on the foundation. Thus for this embodiment a relatively lightly built and economical rotation bearing can also be used. Likewise, the part of the rotating frame 20 lying below the axial bearing 19 may be constructed of light material, since it has to transmit to the foundation only the weight of the travelling frame and of the lifting frame during the rotating procedure.

What I claim is:

1. A transporting and lifting vehicle for a heavy load, e.g. for converter exchange vessels in steel production plants, said vehicle comprising:

a travelling frame capable of being rotated for transposition into different directions of travel and provided with turret-like projections, said projections having recesses;

a climbing-lifting mechanism inserted within said travelling frame, which climbing-lifting mechanism comprises a lifting frame for receiving the converter, said lifting frame being provided with bolts that are extendable into and retractable from the recesses in said projections;

lifting means carried by said lifting frame and having a lifting height smaller than the total lifting height of the vehicle;

traverse-like carriers arranged below said lifting frame and being connected to said lifting means, said traverse-like carriers being provided at their ends with bolts that are extendable into and retractable from the recesses in said projections; and a rotating frame, wherein the bolts of the lifting frame and the bolts of the traverse-like carriers are, after actuating the lifting means, engageable and disengageable alternatingly in turns with the recesses of the turret-like projections.

2. The vehicle set forth in claim 1, wherein the travelling frame is rotatable about a vertical axis for transposition into different directions of travel.

3. The vehicle set forth in claim 1, wherein the lifting means are bilaterally acting hydraulic piston mechanisms.

4. The vehicle set forth in claim 1, wherein the traverse-like carriers are closed hollow frames.

5. The vehicle set forth in claim 1, wherein the travelling frame is rectangular-shaped and has four corners and the turret-like projections are arranged symmetrically in the corners of said travelling frame.

6. The vehicle set forth in claim 1, wherein the bolts of the lifting frame lying opposite each other are adjustable so that the climbing lifting mechanism is horizontally shiftable in relation to the travelling frame and is thus capable of being centered.

7. The vehicle set forth in claim 6, wherein stops are provided in the recesses of the turret-like projections.

8. The vehicle set forth in claim 1, wherein the bolts of the traverse-like carriers lying opposite each other are adjustable so that the climbing lifting mechanism is horizontally shiftable in relation to the travelling frame and is thus capable of being centered.

9. The vehicle set forth in claim 8, wherein stops are provided in the recesses of the turret-like projections.

10. The vehicle set forth in claim 1, wherein said travelling frame, lifting frame and rotating frame enclose a clear inner space of certain dimensions and the lower part of the converter has a certain diameter, said diameter being smaller than the dimensions of the clear inner space enclosed by the travelling frame, the lifting frame and the rotating frame, the converter thus being capable of being lowered through said clear inner space of said frames and placed on a foundation.

11. A transporting and lifting vehicle for a heavy load, e.g. for converter exchange vessels in steel production plants, said vehicle comprising:

a travelling frame capable of being rotated for transposition into different directions of travel and provided with turret-like projections, said projections being provided with bolts that are extendable and retractable;

a climbing-lifting mechanism inserted within said travelling frame, which climbing-lifting mechanism comprises a lifting frame for receiving the converter, said lifting frame being provided with recesses into which said bolts are extendable and retractable;

lifting means carried by said lifting frame and having a lifting height smaller than the total lifting height of the vehicle;

traverse-like carriers arranged below said lifting frame and being connected to said lifting means, said traverse-like carriers being provided at their ends with recesses into which said bolts are extendable and retractable; and a rotating frame carried by said travelling frame, wherein the bolts of the turret-like projections are, after actuating the lifting means, engageable and disengageable alternatingly in turns with the recesses of the lifting frame and the traverse-like carriers.

12. The vehicle set forth in claim 1 further including:

an axial bearing and a rotation drive connecting said rotating frame to said travelling frame;

followers connecting said lifting frame to said travelling frame, said lifting frame carrying the converter in such a way that it can be placed on a foundation; and auxiliary lifting devices on said rotating frame, said auxiliary lifting devices being capable of being actuated after the converter has been placed on a foundation so that upon actuation of the rotation drive the lifting frame and the travelling frame rotate in relation to the rotating frame and in relation to the converter.

13. The vehicle set forth in claim 12, wherein the auxiliary lifting devices are bilaterally acting hydraulic piston mechanisms.

14. The vehicle set forth in claim 1 further including:

an axial bearing and a rotation drive connecting said rotating frame to said lifting frame, and followers connecting said lifting frame to said travelling frame; and wherein said lifting frame carriers the converter in such a way that it can be placed on the ground, said rotating frame is supportable on the ground after the converter has been placed on the ground by retracting said lifting means, and upon further retraction of said lifting means and actuation of the rotation drive, said lifting frame and said travelling frame rotate in relation to said rotating frame and the converter.

15. The vehicle set forth in claim 1 further including:

an axial bearing and a rotation drive connecting said rotating frame to said lifting frame, and followers connecting said lifting frame to said travelling frame; and wherein said rotating frame carries the converter in such a way that it can be placed on the ground, said rotating frame is supportable on the ground after the converter has been placed on the ground by retracting said lifting means, and upon further retraction of said lifting means and actuation of the rotation drive, said travelling frame and said lifting frame rotate in relation to said rotating frame and the converter.

* * * * *

UNITED STATES PATENT AND TRADEMARK OFFICE

CERTIFICATE OF CORRECTION

PATENT NO. : 3,949,884

DATED : Apr. 13, 1976

INVENTOR(S) : Friedrich Despalmes

It is certified that error appears in the above-identified patent and that said Letters Patent are hereby corrected as shown below:

First page, last line of Item 56, "Pultringer" should read --Puhringer--;

First page, line 5 of Abstract, "receives. The converter, the" should read --receives the converter. The--;

Col. 1, line 62, delete "to";

Col. 2, line 19, after "lengths" insert --and--;

Col. 3, line 42, after "a" insert --new--;

Col. 4, line 1, "procedure, also, the" should read --procedure. Also, the--; line 7, after "vehicle" (2nd occurrence) insert a comma;

Col. 5, line 4, after "in the" insert --lowest--;

Col. 7, line 20, delete "as follows:"; line 43, "converters" should read --converter--; line 45, "driveand" should read --drive- and--;

Col. 8, line 11, "ture" should read --true--; and

Col. 10, line 22, "carriers" should read --carries--.

Signed and Sealed this

Sixteenth Day of November 1976

[SEAL]

*Attest:*

RUTH C. MASON
*Attesting Officer*

C. MARSHALL DANN
*Commissioner of Patents and Trademarks*